United States Patent [19]

Kitamura

[11] Patent Number: 4,520,263

[45] Date of Patent: May 28, 1985

[54] COLLATOR WITH PHOTOELECTRIC BIN FILL DETECTION

[75] Inventor: Takashi Kitamura, Yokohama, Japan

[73] Assignee: Canon Kabushiki Kaisha, Tokyo, Japan

[21] Appl. No.: 311,447

[22] Filed: Oct. 14, 1981

[30] Foreign Application Priority Data

| | | | |
|---|---|---|---|
| Oct. 21, 1980 | [JP] | Japan | 55-147085 |
| Oct. 22, 1980 | [JP] | Japan | 55-148657 |
| Oct. 23, 1980 | [JP] | Japan | 55-149065 |
| Dec. 22, 1980 | [JP] | Japan | 55-182468 |
| Dec. 22, 1980 | [JP] | Japan | 55-182467 |
| Dec. 27, 1980 | [JP] | Japan | 55-186522 |

[51] Int. Cl.[3] ..... G01V 9/04

[52] U.S. Cl. ..... 250/223 R; 250/561

[58] Field of Search ..... 250/223 R, 222.1, 561; 271/258, 259, 207, 279, 287–297, 303–305

[56] References Cited

U.S. PATENT DOCUMENTS

| | | | |
|---|---|---|---|
| 3,457,423 | 7/1969 | Gravely | 250/223 R |
| 4,229,650 | 10/1980 | Takahashi et al. | 250/223 R |
| 4,265,440 | 5/1981 | Shibazaki et al. | 271/9 |

*Primary Examiner*—David C. Nelms

*Attorney, Agent, or Firm*—Fitzpatrick, Cella, Harper & Scinto

[57] ABSTRACT

A collator has a common light-emitting element for emitting light to a photosensitive element for detecting an empty bin and to a photosensitive element for detecting a full bin; or a common photosensitive element for receiving light emitted from a light-emitting element for detection of an empty bin and from a light-emitting element for detection of a full bin. The collator allows correct detection of an empty bin and a full bin with fewer members and with simple construction. After detection of a full bin, some sheets already printed by a high-speed printer or the like can still be stacked in a space above the full bin level. Each bin also incorporates a bin inlet sensor to prevent erratic detection of a full bin or an empty bin when a sheet is in the process of being inserted in the bin through the inlet.

10 Claims, 20 Drawing Figures

COLLATOR WITH PHOTOELECTRIC BIN FILL DETECTION

BACKGROUND OF THE INVENTION

1. Field of the Invention

The present invention relates to a collator or sorter for distributing and sorting various types of paper sheets for photocopiers and printers and, more particularly, to a collator which is capable of easily detecting the amount of sheets stacked on a plurality of bins, that is, detecting whether the bin is empty or whether the bin is full and under the overflow condition; and which is also capable of other functions.

2. Description of the Prior Art

According to the conventional method for discriminating empty or full bins in a collator of the type described above, the amount of stacked sheets is detected through the weight of the sheets stacked on the bin. However, with this method, in case the sheet is curled, or the like, and the full bin condition is reached with a small number of sheets stacked on the bin, the full bin condition cannot be detected. In addition, it is difficult to detect the weight of one sheet, so that detection of an empty bin condition is difficult. The conventional collator of this type is thus defective in stability and reliability.

Another conventional collator has also been proposed which incorporates light-emitting elements and light-receiving elements (photosensitive elements) arranged in each of a plurality of bins for discriminating between the empty bin or the full bin. However, the collator of this type becomes complex in structure and requires a larger space. Moreover, since the light-emitting elements and the photosensitive elements must be arranged close to each other, noise of the light source tends to be introduced into the photosensitive elements and the reliability is thus degrated.

The inner wall of the bin inlet of the conventional sorter or the like is straight. Therefore, sheets stacked on the bin may float through the sheet outlet because of a breeze, vibrations, impacts or the like, thus sealing the bin inlet. This may interfere with insertion of the next sheet or erratic detection of the overflow condition when the bin is, in fact, not full.

With a collator of this type, a measure is taken to detect the full condition for sheets inserted in one of a plurality of bins and to stop insertion of the sheets in the bin or transfer to another bin. However, with a recent high-speed printer or the like, when a full bin is detected, another sheet cannot be stacked, or some additional sheets may be stacked but others which have been printed by high-speed printing cannot be stacked any more. For this reason, printing must be started after confirming that the printed sheets may all be stacked on the bin. This significantly slows down the speed of the printer.

SUMMARY OF THE INVENTION

The present invention has been made in consideration of the facts as described above and has for its object to provide an improved and novel collator free from the above defects.

It is another object of the present invention to provide a collator which is capable of easily and correctly detecting an empty bin and a full bin, independently of the kind of sheets supplied or their degree of curling.

It is still another object of the present invention to provide a collator which does not have moving parts for detection purpose and which achieves high reliability in terms of vibrations and impacts.

It is still another object of the present invention to provide a collator which is compact in size and simple in structure, because it has light-emitting elements used for detecting both an empty bin and a full bin so that the power consumption is reduced to the minimum.

It is still another object of the present invention to provide a collator which uses one and the same photosensitive elements for detecting both an empty bin and a full bin, so that the number of photosensitive elements may be reduced to the minimum.

It is still another object of the present invention to provide a collator which commonly uses the same light-emitting element for bins.

It is still another object of the present invention to provide a collator which is capable of detecting an empty bin and a full bin according to the stacking condition of the sheets.

It is still another object of the present invention to provide a collator which is capable of preventing adverse effects of external light on a detecting means.

It is still another object of the present invention to provide a collator which is capable of preventing floating of sheets stacked in a bin.

It is still another object of the present invention to provide a collator which incorporates a projection at the bin inlet to hold the edges of the sheets to prevent the sheets from floating.

It is still another object of the present invention to provide a collator which may not overflow even when sheets are stacked on a bin by a high speed printer.

It is still another object of the present invention to provide a collator which is capable of mounting some sheets even after detection of a full bin.

According to an aspect of the present invention, there is provided a collator which is capable of discriminating between a full state and an empty state for sheets in a plurality of bin members, comprising a first light-emitting element disposed at a sheet stacking section near the bottom of each of the bin members for detecting an empty bin, a second light-emitting element disposed near a sheet inlet of the bin member for detecting a full bin, and a common photosensitive element which is disposed at the bottom of an adjacent bin member and which receives light emitted from the first light-emitting member for detecting the empty bin and from the second light-emitting element for detecting the full bin.

According to another aspect of the present invention, there is provided a collator for discriminating between a full state and an empty state for sheets inserted in a plurality of adjacent bin members, wherein each of the adjacent bin members comprises one photosensitive element disposed near a sheet insertion inlet of the bin member for detecting both an empty bin and a full bin, and one light-emitting element which is disposed at a sheet stacking section near the bottom of the bin member and which emits light to the photosensitive elements of the two adjacent bin members so that the photosensitive element of one of the two adjacent bin members detects the full bin and the photosensitive element of the other bin member detects the empty bin.

According to still another aspect of the present invention, there is provided a collator for discriminating between a full state and an empty state for sheets inserted into a plurality of adjacent bin members, comprising a first photosensitive element for detecting an empty bin which is disposed at the bottom of a sheet stacking section of each of the bin members, a second photosensitive element for detecting an empty bin which is disposed near a sheet insertion inlet of the bin member, and a common light-emitting element which is disposed near the sheet insertion inlet and which emits light to the first photosensitive element for detecting the empty bin and to the second photosensitive element for detecting the full bin.

According to still another aspect of the present invention, there is provided a collator for discriminating between a full state and an empty state for sheets inserted in a plurality of bin members, comprising a first photosensitive element for detecting a full bin which is disposed near a sheet insertion inlet of each of the bin members, a second photosensitive element for detecting an empty bin which is disposed near the bottom at the sheet insertion inlet side of each of the bin members, and a common light-emitting element which emits light to the first and second photosensitive elements toward the leading end of the bin member along the direction of travel of the sheets.

According to still another aspect of the present invention, there is provided a collator for consecutively stacking and storing sheets in a plurality of bin members, which incorporates a projection near a sheet insertion inlet of each of the bin members to thereby define a recess near the end of a sheet mounting section of the bin member, whereby floating of the sheets may be prevented.

According to still another aspect of the present invention, there is provided a collator for consecutively stacking and storing sheets in a plurality of bin members, which incorporates a full bin detection member at a position on the bin member at a predetermined distance from a sheet insertion inlet of the bin member to thereby allow stacking of a predetermined number of sheets independently of the detection of a full bin by the full bin detection member.

With the constructions of the present invention as described above, various technical advantages as described below may be obtained.

Detection of a full bin or an empty bin may be performed independently of the kind and condition of the sheets. Since the same member is used for detecting both a full bin and an empty bin, the collator may be made compact in size and simple in construction.

Detection of a full bin or an empty bin may be easily and correctly performed independently of the kind of sheets or degree of curling of the sheets. Reliability against vibrations and impacts is high. Since light-emitting elements are also used, the power consumption may be reduced and the collator may be made compact in size.

The photosensitive elements need not be arranged close to the light-emitting elements for detecting a full bin and an empty bin, so that reliability is high. Since the same light-emitting element may be used for detecting both an empty bin and a full bin, the construction of the collator may be made simple. In addition, the detection may be performed with precision, independently of the stacking state of the sheets.

The floating of sheets stacked in the bins may be prevented, and detection of a full bin or an empty bin may be performed with precision.

When the collator of the present invention is applied to a high-speed printer or the like, the sheets will not overflow when stacked in the bins.

DESCRIPTION OF THE PREFERRED EMBODIMENTS

Figure 1:
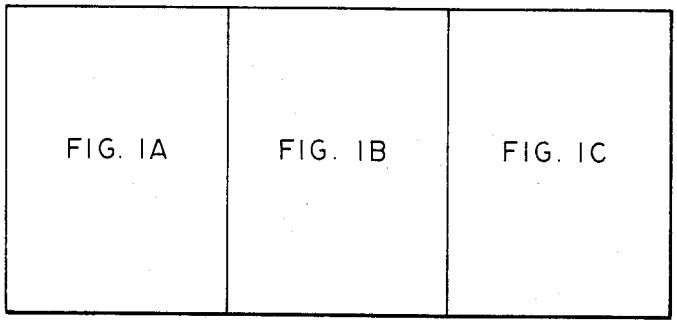
FIGS. 1*a*, 1*b* and 1*c* are sectional views of a collator according to an embodiment of the present invention.
Figure 1C:
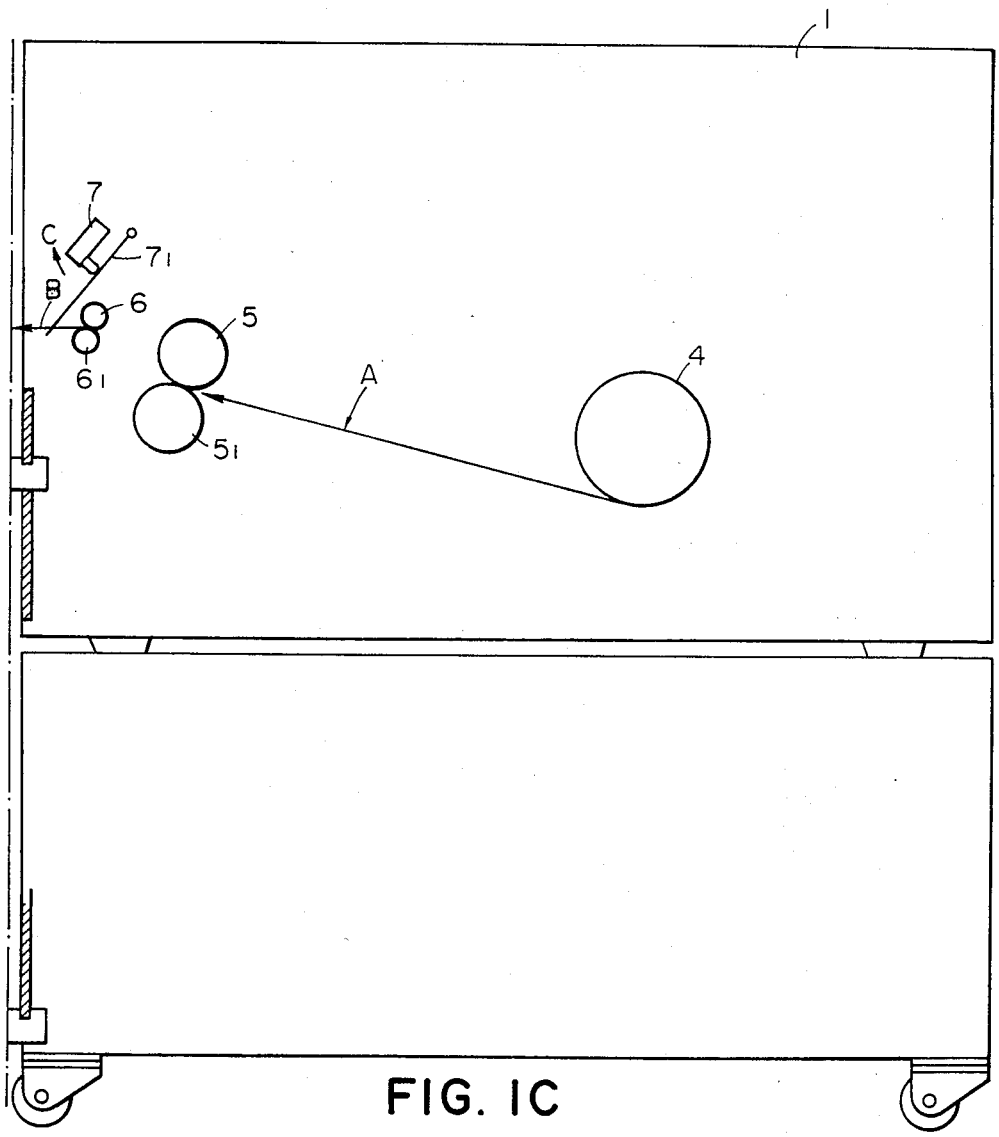
Figure 1A:
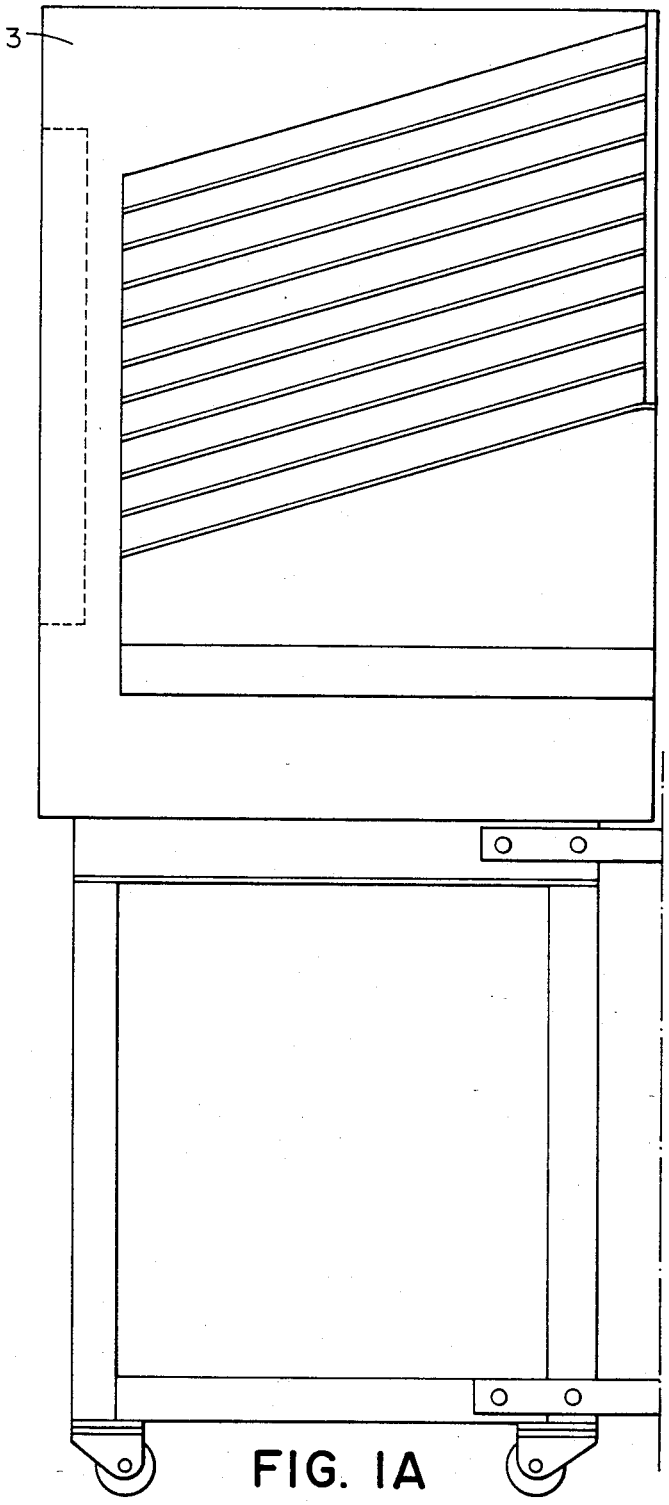
Figure 1B:
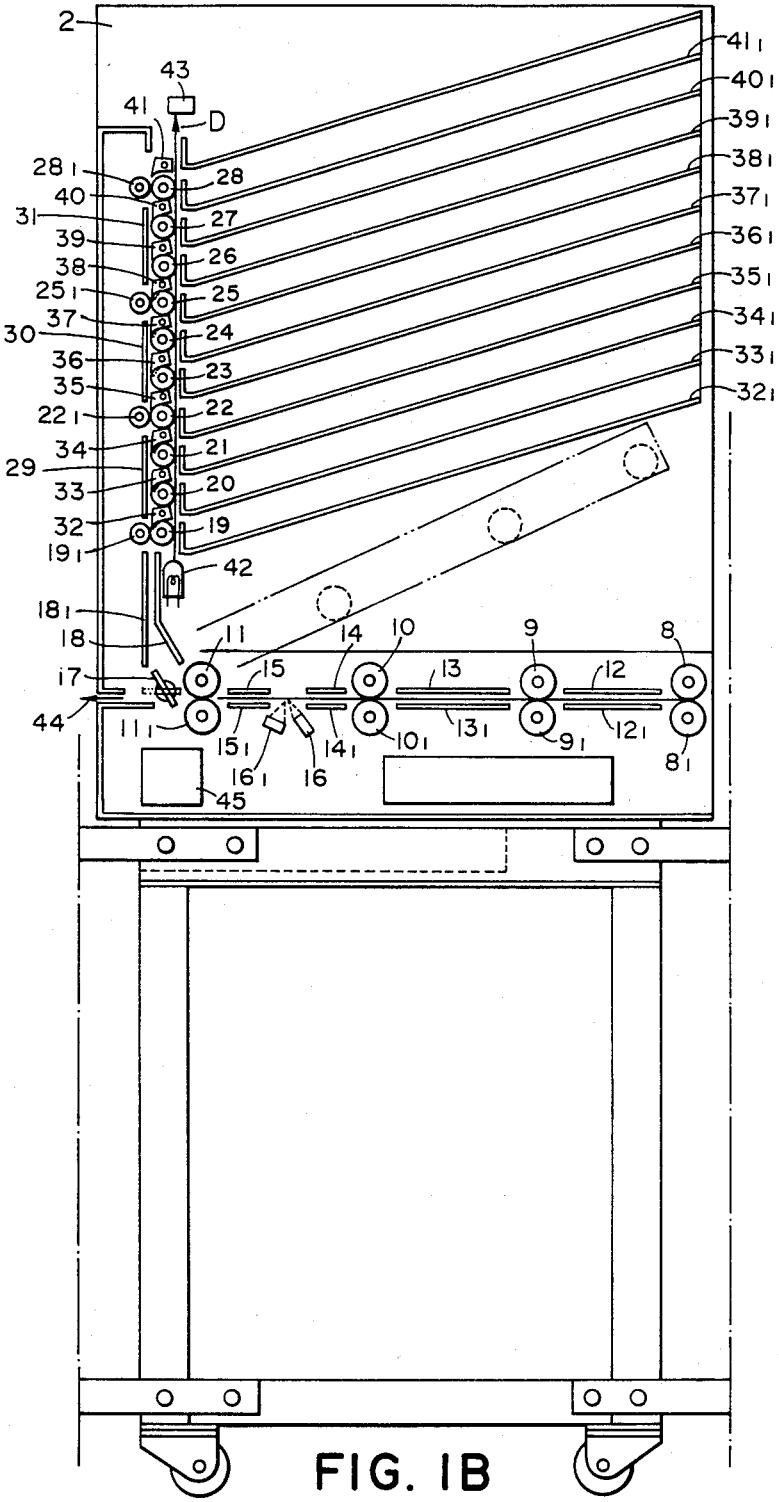

The preferred embodiments of the present invention will now be described with reference to the accompanying drawings. FIGS. 1 to 1*c* illustrate a collator according to an embodiment of the present invention, showing a laser beam printer 1 (to be referred to as an LBP hereinafter), and first and second sorters 2 and 3 which are of the same kind. In the LBP 1, image data formed on a photosensitive drum 4 by a laser, a deflector, an electrostatic device or the like (not shown) is transferred to a sheet which is conveyed in the direction indicated by arrow A. The image transferred on the sheet is fixed by a fixer comprising a pair of rollers 5 and $5_1$, and the sheet with the fixed image is exhausted in the direction shown by arrow B by discharge rollers 6 and $6_1$. The sheet then pivots a lever $7_1$ of an discharge sensor 7 in the direction indicated by arrow C. The sheet is then conveyed horizontally as guided by horizontal conveying rollers 8 and $8_1$, 9 and $9_1$, 10 and $10_1$, and 11 and $11_1$, and horizontal guides 12 and $12_1$, 13 and $13_1$, 14 and $14_1$, and 15 and $15_1$ (FIG. 1B). The passing position of the sheet in the horizontal conveying path is detected by a light source 16 and a photosensitive element $16_1$. The sheet which has passed the gap between the horizontal convey rollers 11 and $11_1$ is then guided to a vertical conveying section by a sorter switch guide 17 at the normal position (position shown by the solid line). The sheet guided by vertical guides 18 and $18_1$ is subsequently guided by vertical conveying rollers 19 and $19_1$, 20, 21, 22 and $22_1$, 23, 24, 25 and $25_1$, 26, 27 and 28 and $28_1$; vertical guides 29, 30 and 31 interposed between these vertical conveying rollers; and bin switch pawls 32, 33, 34, 35, 36, 37, 38, 39, 40 and 41 operated by a switching means. The sheet is then stacked in one of bins $32_1$, $33_1$, $34_1$, $35_1$, $36_1$, $37_1$, $38_1$, $39_1$, $40_1$ and $41_1$. The vertical conveying rollers 19 and $19_1$, 22 and $22_1$, 25 and $25_1$ and 28 and $28_1$ comprise pinch rollers to guide the sheets upward. Bin inlet sensors 42 and 43 are located at the positions shown in FIG. 1B. Light emitted from the bin inlet sensor 42, which is a lamp, is transmitted between the bin inlet and the vertical conveying rollers in the direction indicated by arrow D to become incident on the bin inlet sensor 43, which is a photosensitive element.

When the sorter switch guide 17 is switched by a solenoid or the like to the position indicated by the broken line, the sheet is directly guided from an outlet port 44 of the first sorter 2 to the second sorter 3. The second sorter 3 is of the same construction as the first sorter 2 and the description thereof will therefore be omitted. A drive motor 45 drives, through a suitable transmitting means such as a belt (not shown), the vertical conveying rollers and horizontal conveying rollers.

Figure 2:
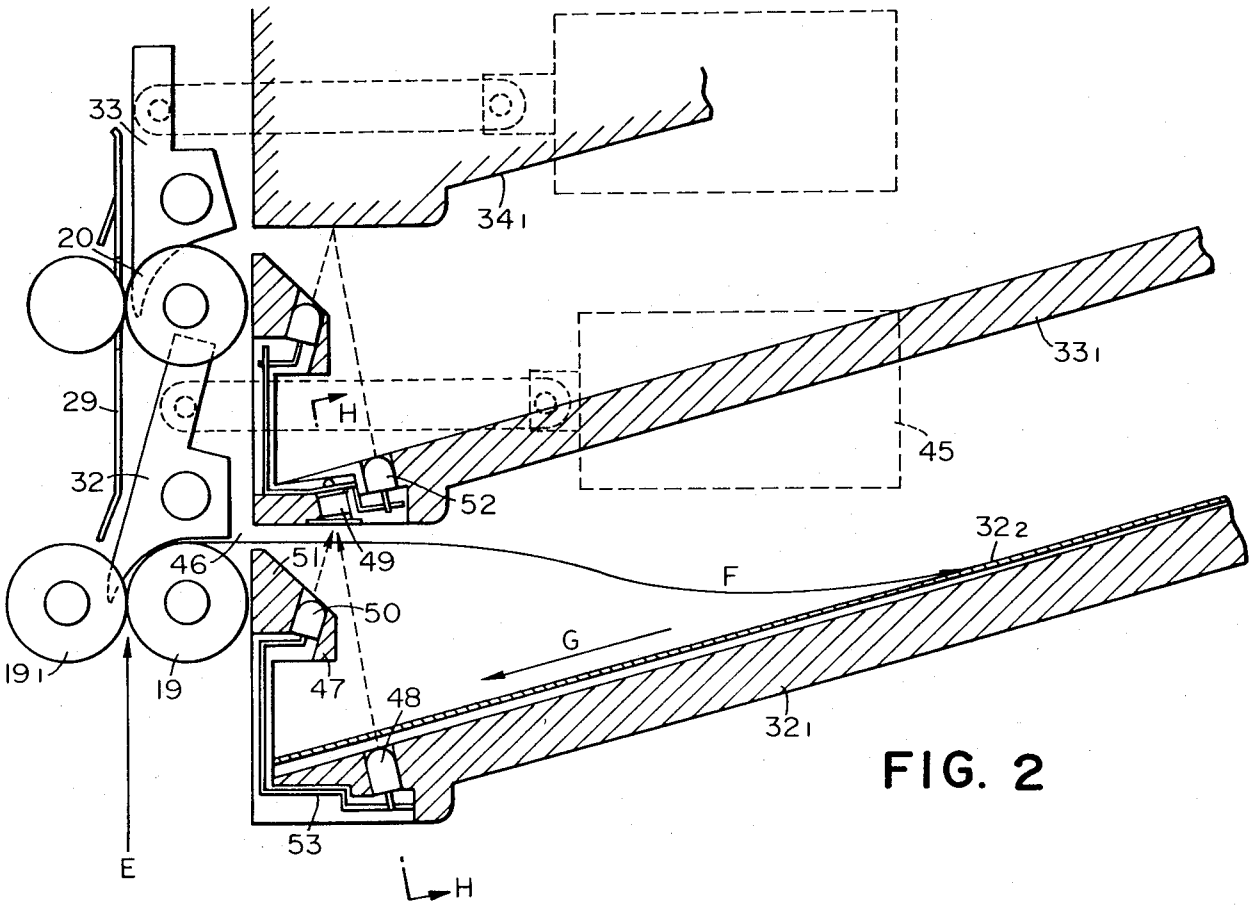
FIGS. 2 and 3 are partial sectional views of a detecting mechanism for detecting a full bin and an empty bin.
Figure 3:
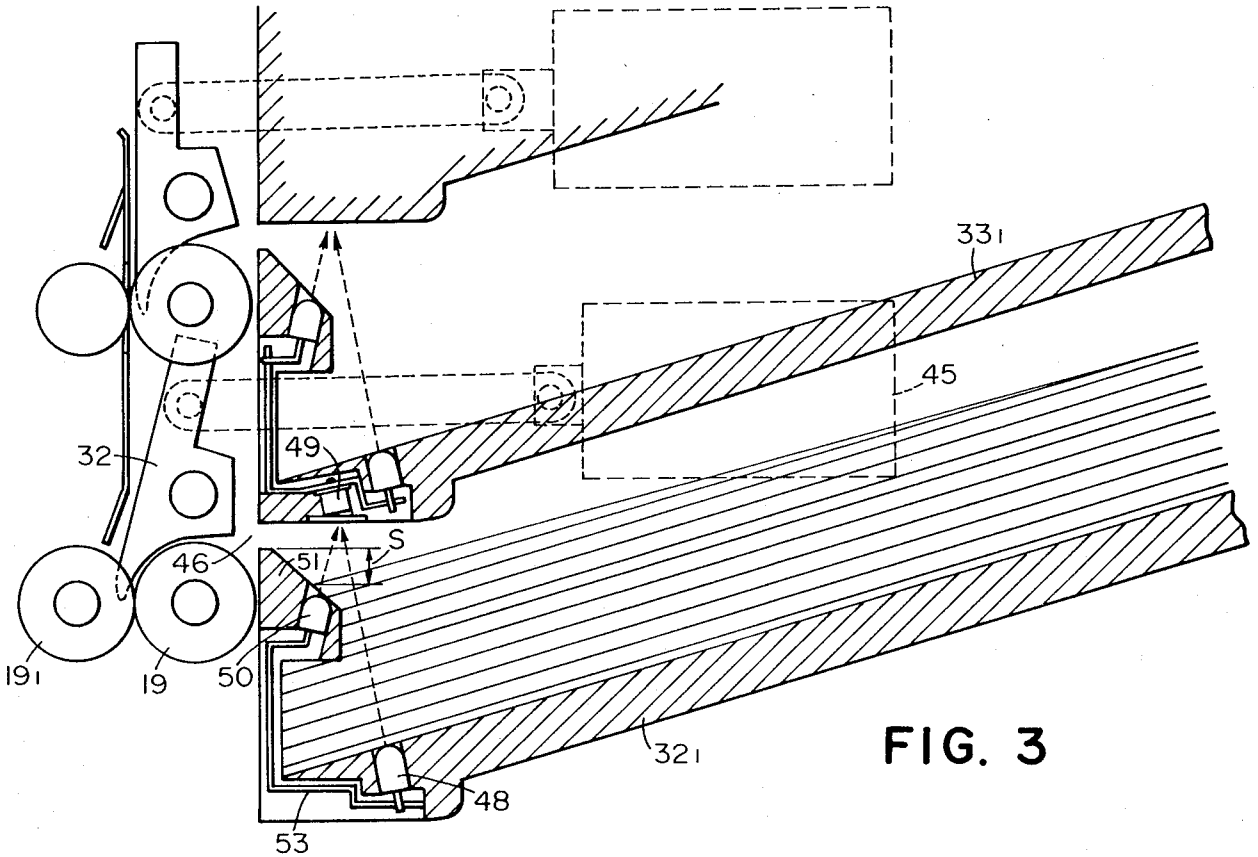

A detecting mechanism for detecting a full state or an empty state for sheets stacked on bins will now be described with reference to FIGS. 2 and 3 which are partial, enlarged sectional views of the mechanism. Referring to these figures, the sheet fed in the direction indicated by arrow E is guided by the vertical conveying rollers 19 and $19_1$ and the bin switch pawl 32 which is pivoted in advance by a solenoid and fed in the direction indicated by arrow F. The sheet then passes through an inlet 46 of the bin $32_1$ and is conveyed to a bin bottom $32_2$. The sheet then slides along the bin bottom $32_2$ along the direction indicated by arrow G and is stacked below a projection 47. Light emitted from an LED (light-emitting diode) 48 is thus blocked by the stacked sheet and cannot reach a detector 49 (FIG. 2). When sheets are subsequently stacked above the level of the projection 47 until it blocks light emitted from an LED 50, the detector 49 detects that the bin $32_1$ is full (FIG. 3). An inclined surface 51 is defined with a clearance S between the uppermost sheet and the inlet 46 of the bin $32_1$ even when the sheets are so stacked in the bin $32_1$ that the detector detects full. When the full bin is detected, it is generally the case that several sheets have already been printed. These printed sheets may be further stacked on the full bin $32_1$. This clearance S provides enough space for these printed sheets. The detector 49 has an optical filter 52 which transmits the light emitted from the LEDs 48 and 50. The detector 49 is arranged in right opposition to the LED 48 at a fixed distance but is inclined with respect to the LED 50, which is closer to the detector, thus adjusting the amount of light. The LED 50 is disposed within the projection 47 having the inclined surface 51 near the bin inlet 46. The LEDs 50 and 48 are connected through a flexible substrate 53. The bins $33_1$, $34_1$ and so on are of the same construction, and the sheets are inserted in the respective bins by the bin switch pawls 32 and 33 which are switched by solenoids.

Figure 4:
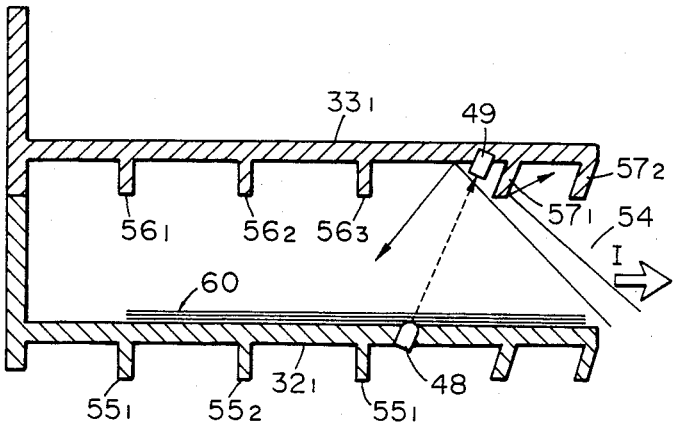
FIG. 4 is a sectional view along the line H—H in FIG. 2.

FIG. 4 is a sectional view along the line H—H of FIG. 2. The sheet stacked on the bin $32_1$ may be taken away through an outlet 54 in the direction indicated by arrow I. The bins $32_1$ and $33_1$ have reinforcing ribs $55_1$, $55_2$, $55_3$, $56_1$, $56_2$ and $56_3$. Ribs $57_1$ and $57_2$ closer to the outlet 54 beyond the detector 49 are inclined inward so as to prevent the detector 49 from being exposed to external light introduced through the outlet 54.

Figure 5:
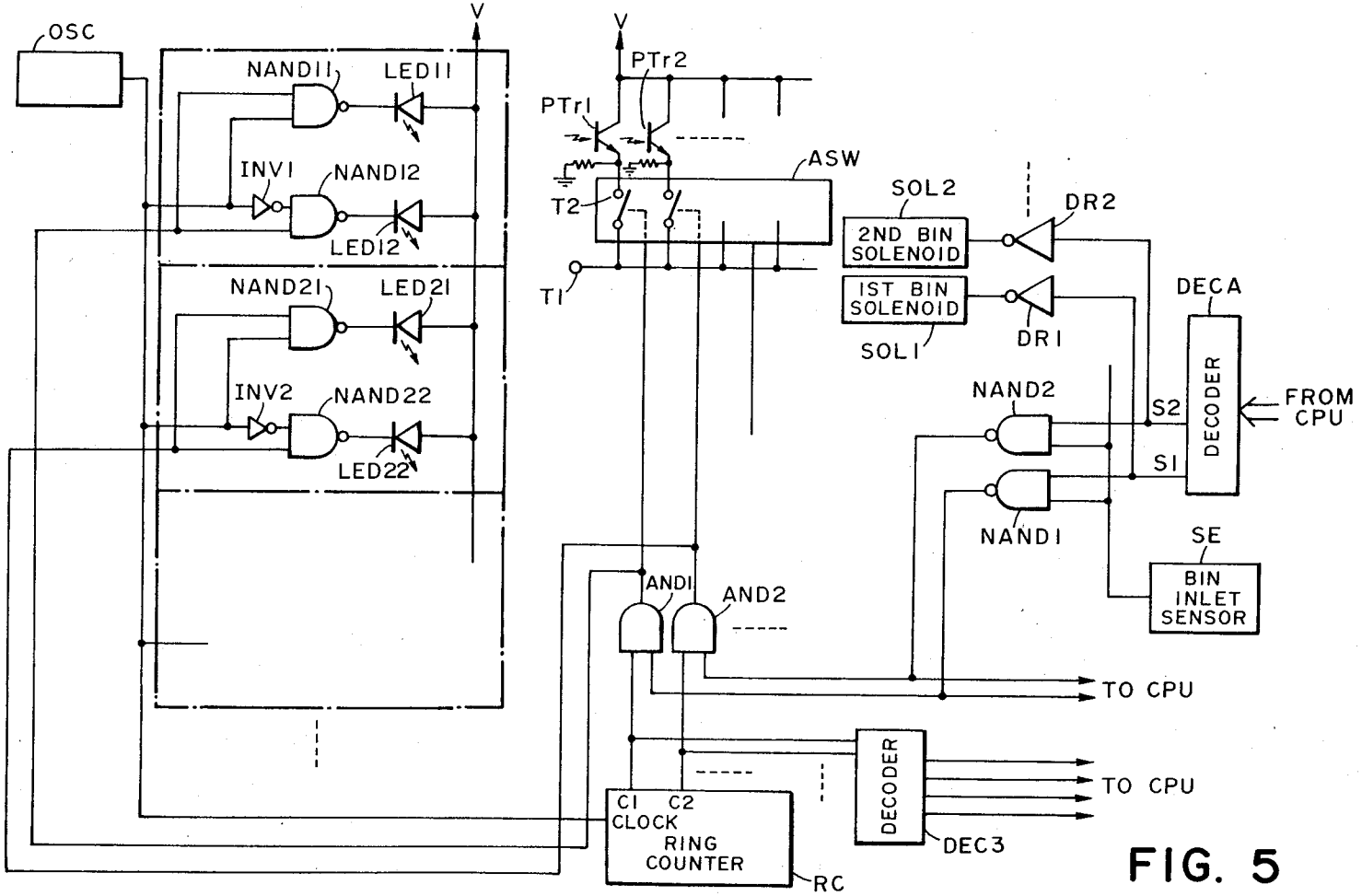
FIGS. 5 and 6 are, respectively, a circuit diagram of a detecting circuit for detecting a full bin and an empty bin and a timing chart thereof.
Figure 6:
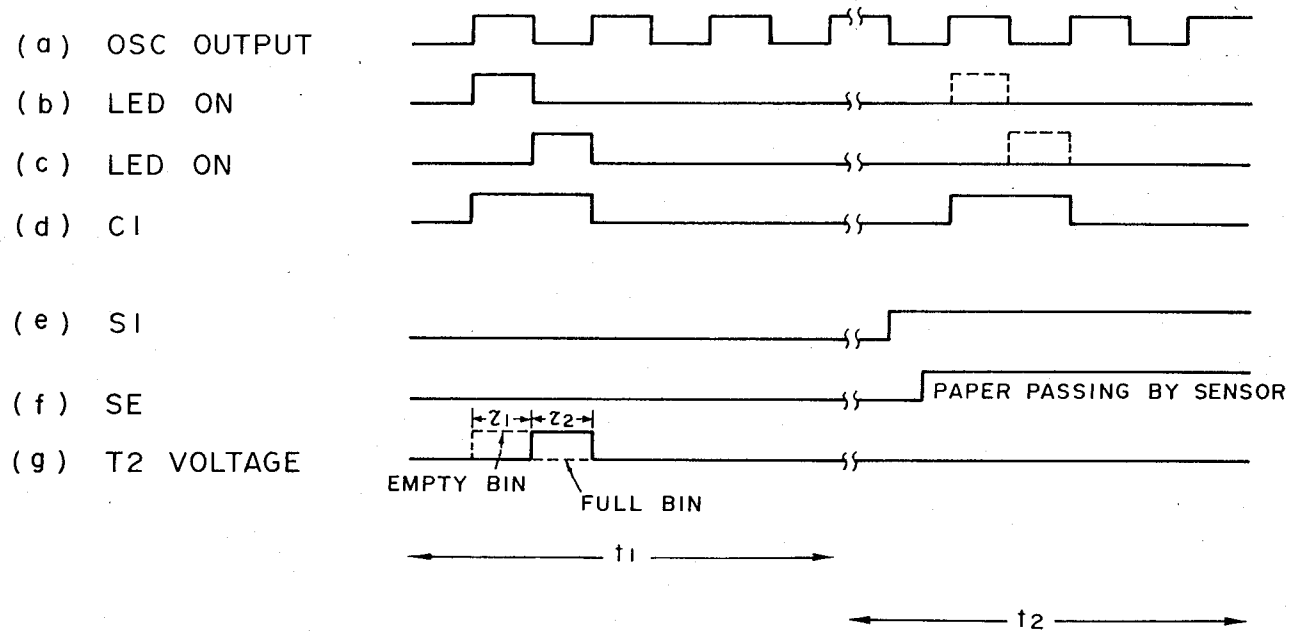

FIG. 5 shows a circuit diagram of a control circuit according to the embodiment shown in FIG. 1, and FIG. 6 is a timing chart of the respective parts in FIG. 5.

Referring to FIG. 5, the control circuit has a clock oscillator OSC, a ring counter RC, decoders DECA and DECB, a bin inlet sensor SE, a ring counter DSW, and LEDs, LED11 and LED12. The LEDs 11 and 12 are light-emitting diodes for sensing the empty state and the full state of the first bin, and similar pairs of LEDs are incorporated for each of the remaining bins. The control circuit also has NAND gates NAND1, NAND2, NAND11 and NAND12; AND gates AND1 and AND2; inverters INV1 and INV2; solenoid drivers DR1 and DR2; solenoids SOL1 and SOL2; and phototransistors PTr1 and PTr2 for detecting a full state or an empty state of the first bin and the second bin. The gates, the solenoids, the drivers and the phototransistors are incorporated for each bin. The mode of operation of this control circuit will now be described.

The clock pulses generated by the clock oscillator OSC are input to the ring counter RC and sequentially make outputs C1, C2, . . . of the ring counter RC go to high level "H". When the output of the NAND gate NAND11 is at level "H" and the clock pulse is at level "H", the output of the NAND gate NAND11 is at low level "L" and the light-emitting diode LED11 for detecting the empty state of the first bin is lit. When the LED11 is lit and the first bin is empty, the light becomes incident on the phototransistor PTr1. Since a switch SW1 of an analog switch ASW is closed at this time, the detection output level from a terminal T1 is "H".

When the clock pulse from the clock oscillator OSC is at level "L", the output of the NAND gate NAND12 goes to level "L" and the light-emitting diode LED12 for sensing the full state of the first bin is lit. When the LED12 is lit and the first bin is full, the light does not become incident on the phototransistor PTr1 and the detection output level from the terminal T1 is "L". When the clock pulse of the clock oscillator OSC is at level "H" again, the output $C_2$ of the ring counter RC goes to level "H", and the full state or the empty state is detected for the second bin. The detection of a full bin or an empty bin is performed for all the bins in this manner. The terminal T1 is connected to a microprocessor CPU for sorter control (not shown). The output of the ring counter RC is also sent to the CPU through the decoder DECB so that the CPU may be capable of discriminating the full state or the empty state for each of the bins.

Based on the detection result of the full bin and the empty bin, the CPU (not shown) generates a selection signal to select a bin to store the sheet fed out. This selection signal is input to the decoder DECA which generates a signal S1, S2, . . . or the like to drive the solenoid driver DR1, DR2, . . . or the like and to operate the solenoids SOL1, SOL2, . . . or the like, thereby opening the bin.

The output of the decoder DECA is output to the NAND gates NAND1 and NAND2. When the sheet fed out is sent to and inserted in the bin, it passes between the light-emitting diodes and the phototransistor for sensing the empty bin and the full bin. The detection outputs of the empty bin or the full bin at this instant must be cancelled.

The bin inlet sensor SE is incorporated to cancel such detection outputs. The bin inlet sensor SE produces an output of level "H" which is input to the NAND gates NAND1, NAND2, . . . . For storing the sheet in a bin selected by the CPU, the output of the NAND gate corresponding to this bin goes to level "L". The corresponding AND gates AND1, AND2, . . . are opened and a sheet storing signal is sent to the CPU. In this manner, the CPU may not discriminate a full bin when the sheet is in the process of being stored in a bin.

FIG. 6 is a timing chart for each part in the circuit shown in FIG. 5. Time interval t1 in the timing chart corresponds to performing the general detection of a full bin or an empty bin. Time interval t2 in the timing chart corresponds to performing storing of sheets in the first bin.

When the first bin is neither a full bin nor an empty bin, a voltage at a terminal T2 changes as shown by the solid line in FIG. 6(*g*).

When the first bin is an empty bin, a voltage at the terminal T2 goes to level "H" during the time interval t1. When the first bin is a full bin, the voltage at the terminal T2 goes to level "L" during the time interval t2.

During storing the sheets in the first bin, the output of the bin inlet sensor SE goes to level "H" and the LED11 and LED12 are not lit. The voltage at the terminal T2 does not change.

With the construction of the present invention as described above, detection of a full bin or an empty bin may be performed without failure, independently of the kind and state of the sheets to be stacked. Since the same members serve to detect both the full bin and the empty bin, the collator may be made compact in size and simple in construction.

Another embodiment of the present invention will now be described with reference to the accompanying drawings. FIGS. 7 to 10 are partial, enlarged sectional views of a detecting mechanism for the sheets. A description will be made on the bins $32_1$ and $33_1$, referring to these figures. The bin switch pawls 32 and 33 are arranged to be pivotal by solenoids 58 and 59. In the bins $32_1$ and $33_1$, light-emitting elements 60 and 61 are arranged near the center of the bottom, and the photosensitive elements 62 and 63 are arranged near the sheet insertion inlets of the bins for detecting the stacking condition (empty bin or full bin) of the sheets. The light-emitting element 61 is oriented in the direction H to emit equal amounts of light to the photosensitive elements 62 and 63. The photosensitive element 62 is oriented in the direction I to receive equal amounts of light emitted by the light-emitting elements 60 and 61. Flexible substrates 64 and 65 support the light-emitting elements 60 and 61 and the photosensitive elements 62 and 63. The construction of the other bins is the same as the bins $32_1$ and $33_1$.

Figure 7:
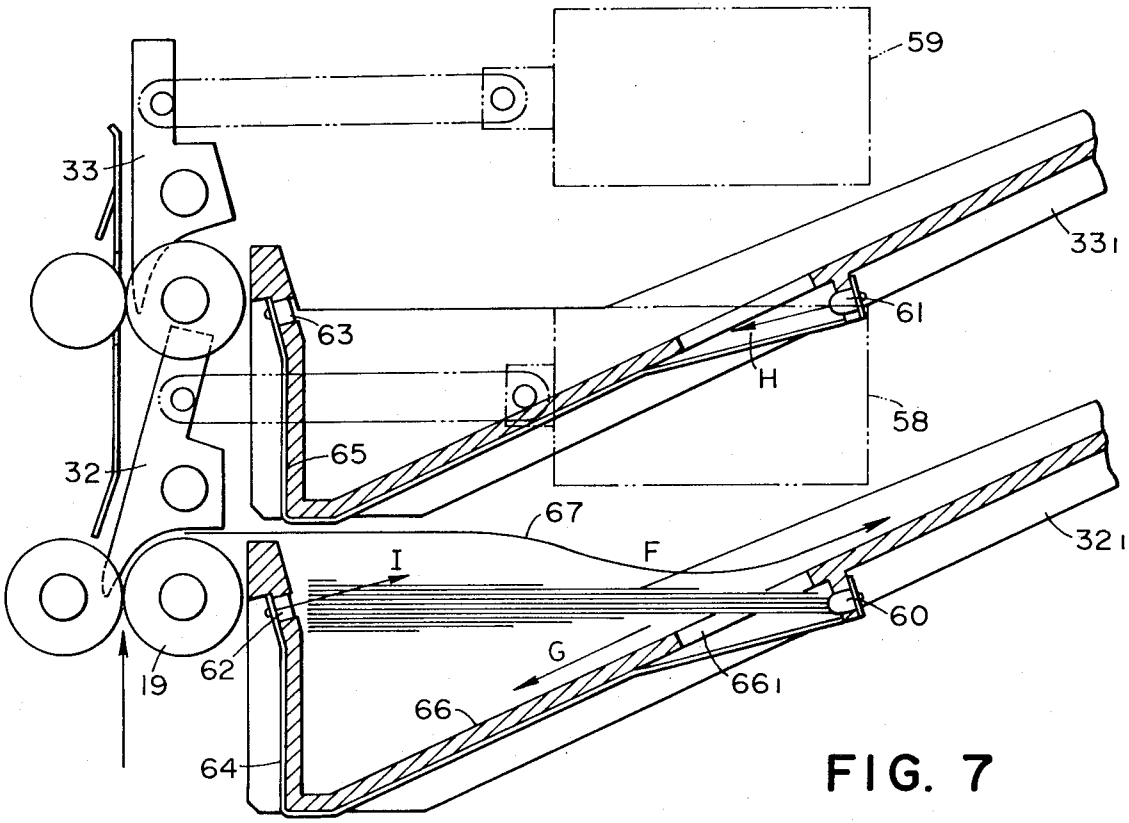
FIGS. 7, 8, 9 and 10 are partial, enlarged sectional views of another detecting mechanism.
Figure 8:
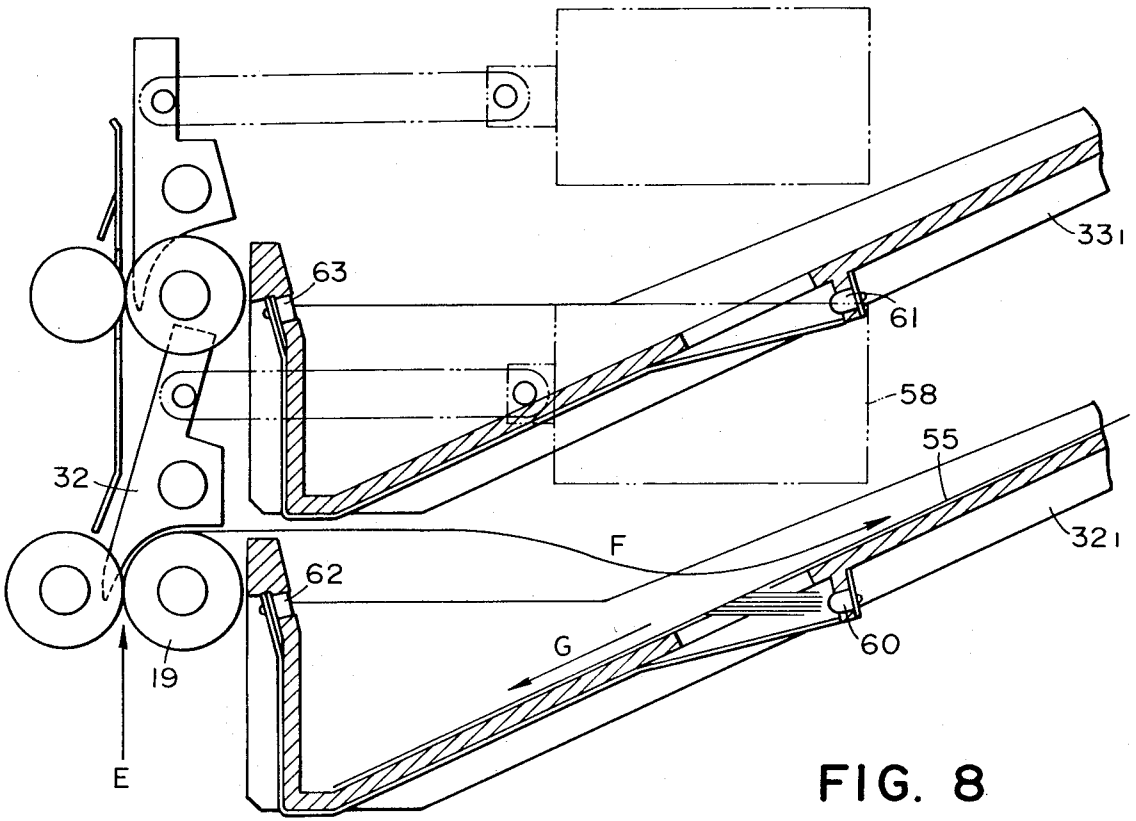

The mode of operation for detection of an empty bin and a full bin will now be described. If no sheet is stacked in the bin $32_1$ as shown in FIG. 7, when the light-emitting element 60 is driven, it emits light which passes through a hole $66_1$ formed in a bin bottom 66 to become incident on the photosensitive element 62. The output of the photosensitive element 62 at this moment is at level "H", thus enabling detection of an empty bin. A sheet 67 sent from the direction of arrow E is guided in the direction of arrow F by the vertical conveying roller 19 and the bin switch pawl 32 which is in the pivoted position by the solenoid 58. The sheet 67 is then placed on the bin bottom 66 as shown in FIG. 8 and slides in the direction of arrow G. When the light-emitting element 60 is driven under this condition (the bin $32_1$ shown in FIG. 8), the light emitted by the light-emitting element 60 is blocked by the stacked sheet and does not reach the photosensitive element 62. Therefore, the output of the photosensitive element 62 goes to level "L".

Figure 9:
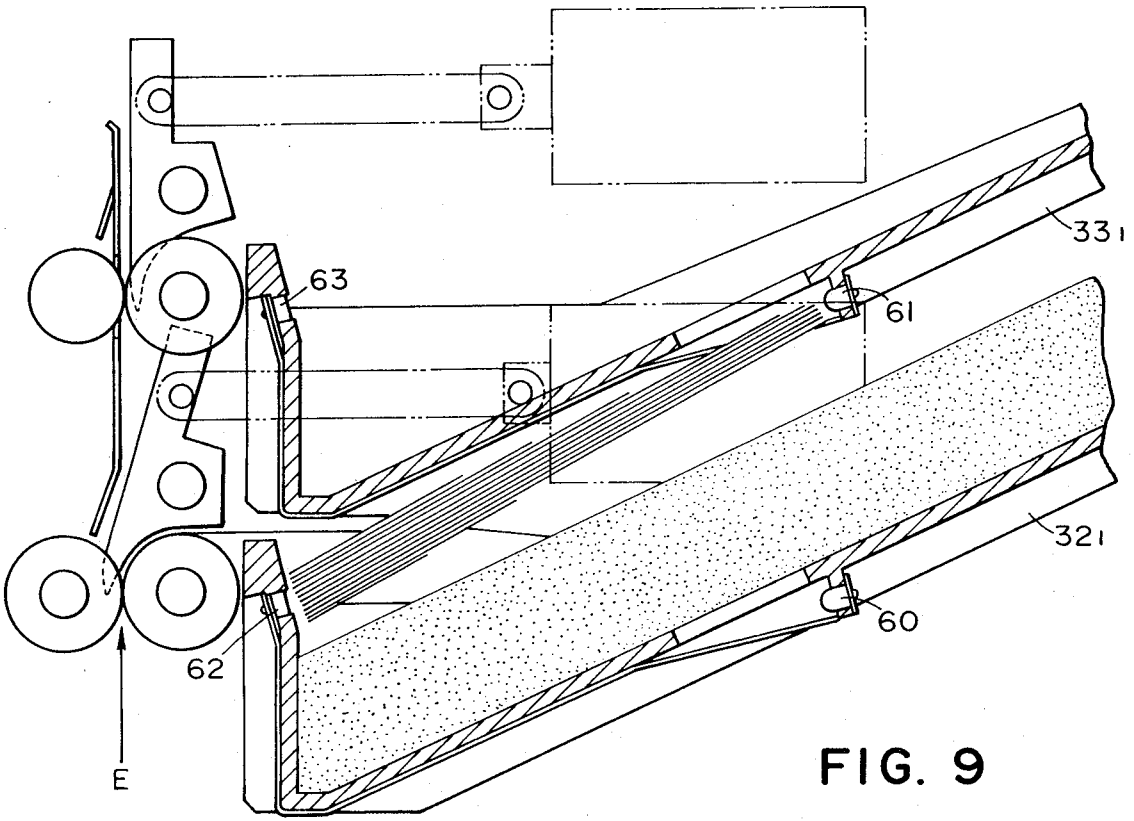
Figure 10:
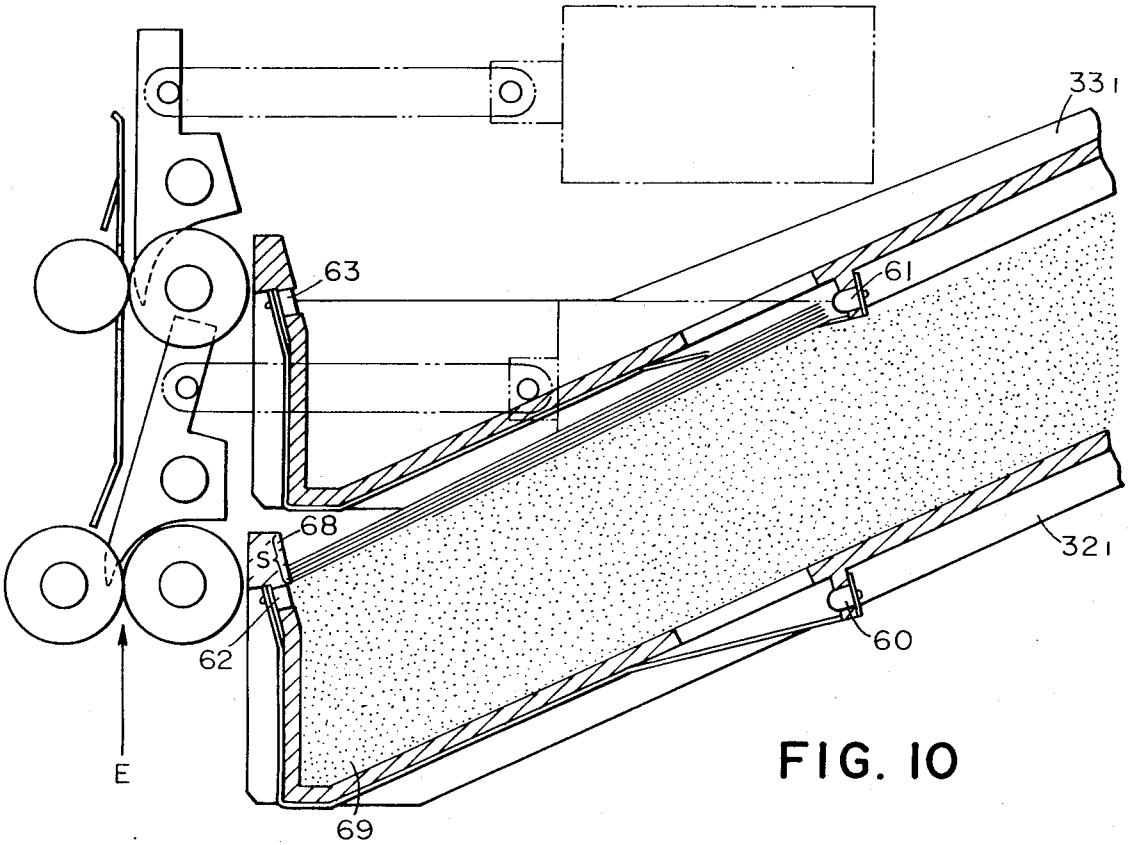

The mode of detection of the full bin will now be described. Under the condition that subsequent sheets are stacked in the bin $32_1$ as shown in FIG. 9, when the light-emitting element 61 is driven, the light emitted from the light-emitting element 61 is not blocked and reaches the photosensitive element 62. Therefore, the output of the photosensitive element 62 goes to level "H" and a full bin is not detected. Assume that the sheets are further stacked as shown in FIG. 10 and the level of the stack reaches, for example, about one-third up an inclined surface 68 having a hole for holding the photosensitive element 62. When the light-emitting element 61 is driven under this condition, the light emitted from the light-emitting element 61 is blocked by sheets 69 and does not reach the photosensitive element 62. Therefore, the output of the photosensitive element 62 goes to level "L" and a full bin is thus detected. Under the condition shown in FIG. 10, the bin $32_1$ is detected to be full of the sheets 69. However, the clearance S remains at the inlet portion of the bin $32_1$. When a full bin is detected, several sheets have already been printed in some cases. In order to prevent these sheets from being stacked in a completely full bin $32_1$, the clearance S is arranged to provide extra space for these sheets in the embodiment of the present invention.

The detection of an empty bin or a full bin is performed in a similar manner for the other bins as well. However, for detection of a full bin for the uppermost (last) bin, an imaginary bin is incorporated and a light-emitting element may be arranged at the corresponding part of the imaginary bin.

Figure 11:
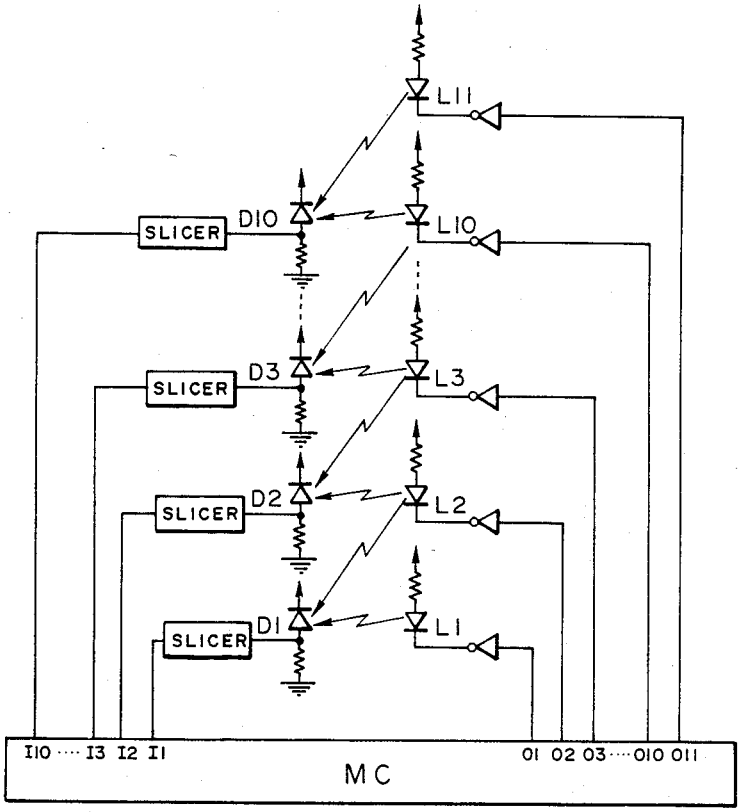
FIGS. 11 and 12 are, respectively, a circuit diagram of the mechanism shown in FIGS. 7 to 10 and a flow chart thereof.
Figure 12:
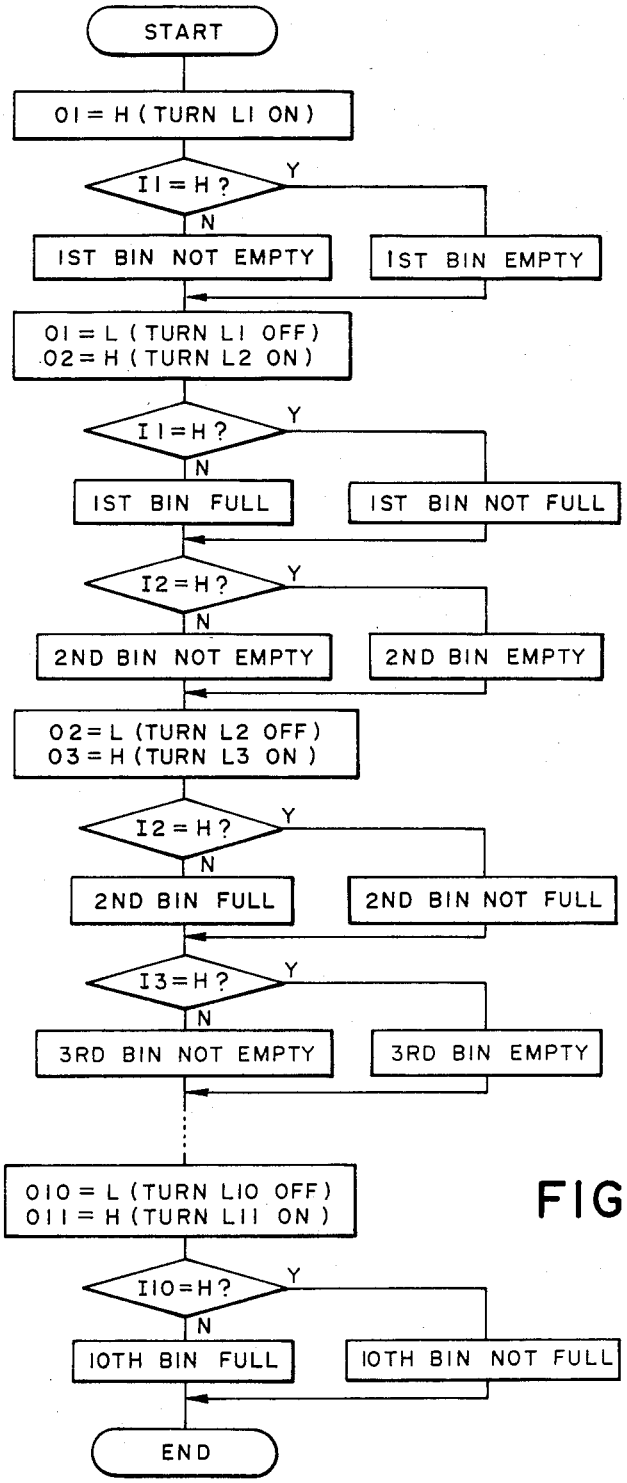

The configuration of the detecting circuit described above and the corresponding flow chart are shown in FIGS. 11 and 12, respectively. Referring to FIG. 11, light-emitting diodes L1 to L11 are arranged in opposition to photosensitive diodes D1 to D10. A slicer is connected to the output end of each of the photosensitive diodes D1 to D10. The slicer comprises a comparator which generates a signal to a microcomputer MC when the amount of light received by the corresponding photosensitive diode exceeds a predetermined value. The output ends of the photosensitive diodes D1 to D10 are connected to input terminals I1 to I10 of the MC, and output terminals 01 to 011 of the MC are connected to input ends of the light-emitting diodes L1 to L11. Therefore, the printer can obtain from the MC data on the stacking condition of the bin to which the sheet is going to be stacked before feeding this sheet is fed. The sorter starts performing the program as shown in FIG. 12 at a certain timing, for example, several seconds after the detection of the signal from the bin inlet sensor SE. In the initial condition, the input terminals I1 to I10 and the output terminals 01 to 011 are reset. When the output terminal 01 of the MC is set first, the light-emitting diode L1 emits light. If the input terminal I1 is set to high level (to be referred to as level "H" hereinafter), the first bin is empty. The MC stores the data "empty bin" for the first bin in a specified address a1 (set a1) and resets the input terminal I1. When the input terminal I1 is reset and goes to low level (to be referred to as level "L" hereinafter), the first bin is not empty. In this case, the MC stores the data "not empty" for the first bin in the address a1 (reset a1).

When the output terminal 01 is reset (the light-emitting diode L1 is turned off) and the output terminal 02 is set, the light-emitting diode L2 is lit. If the input terminal I1 is set and goes to level "H", the first bin is not full. Then, the MC stores the data "not full" for the first bin in a next address a2 (reset a2) and resets the input terminal I2. If the input terminal I1 is at level "L", the first bin is a full bin. In this condition, the MC stores the data "full bin" for the first bin in the address a2 (set a2) and resets the input terminal I1.

While the output terminal 01 is kept set, the input terminal I2 will be considered. When the input terminal I2 is set, the second bin is empty and the MC stores the data "empty bin" for the second bin in a next address a3 (set a3) and resets the input terminal I2. If the input terminal I2 is at level "L", the second bin is not an empty bin. Then, the MC stores the data "not empty" for the second bin in the address a3 (reset a3). The above procedure is performed for all the bins. As a result, empty bin data and full bin data are stored in the addresses a1 to an [addresses (a with odd numbers) store empty bin data and addresses (a with even numbers) store full bin data; and n is the number of bins multiplied by 2]. This entire process is performed every time a sheet is stacked on a bin and the addresses a1 to an are rewritten in every such process.

Before feeding the next sheet, the printer acquires data on the stacking condition of the bin for receiving this sheet. For example, for feeding the sheet to the first bin, the data in the address a2 is examined. If the address a2 is set, it indicates a full bin. Then, the printer displays a sorter error and does not perform printing.

When the printer receives data from a host computer for exclusive use of a bin, the printer may check the status of the addresses a1, a3, a5, . . . to select a bin under the set condition (empty bin) and to feed the sheet to the selected bin.

Figure 13:
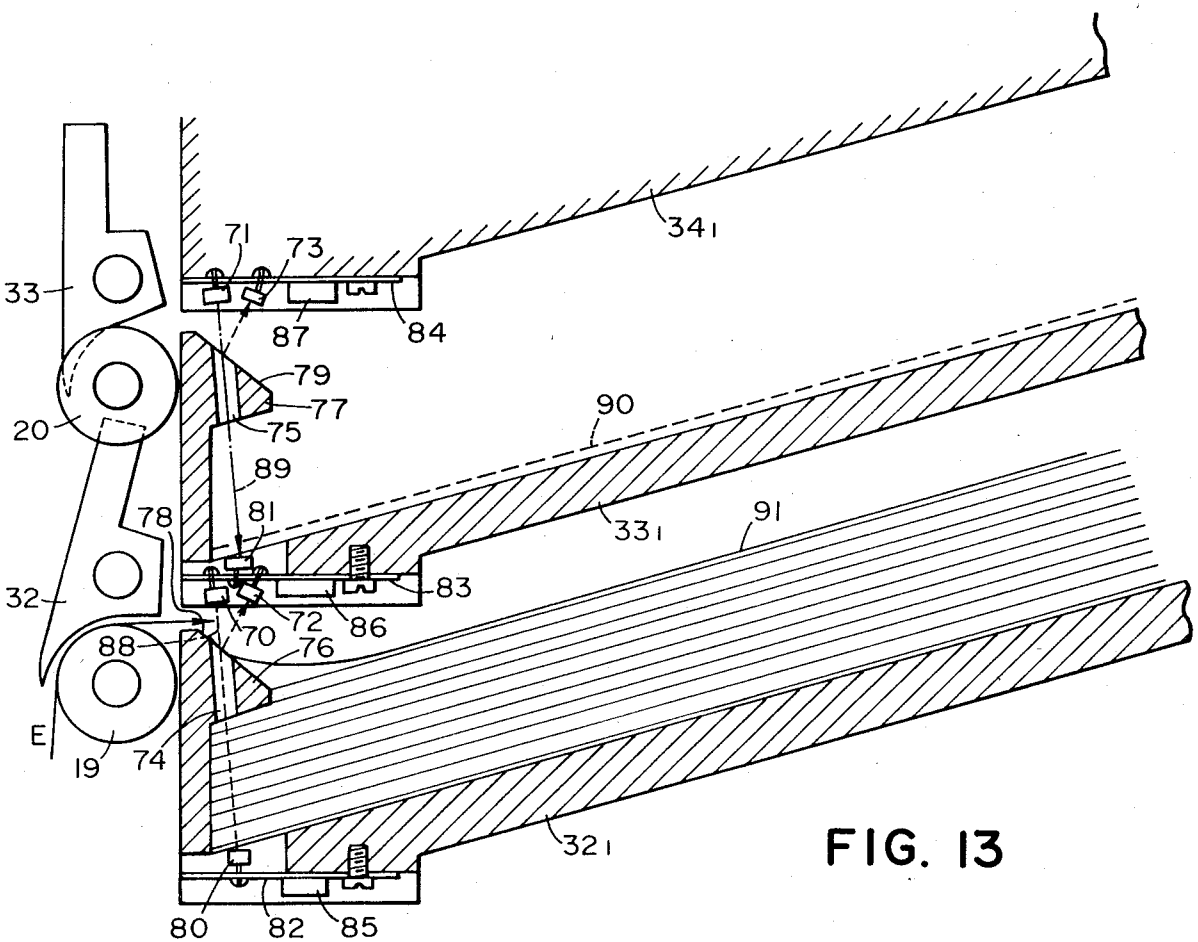
FIG. 13 is a partial, enlarged sectional view of still another detecting mechanism.
Figure 14:
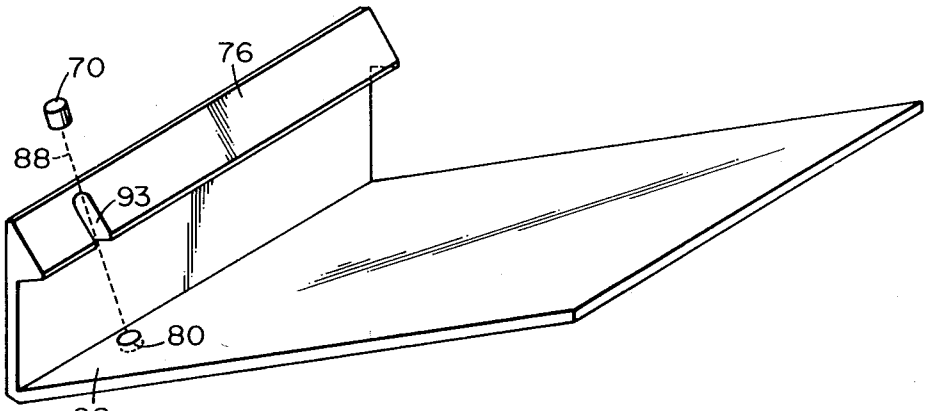
FIG. 14 is a perspective view of a bin.

Still another embodiment of the present invention will now be described with reference to the accompanying drawings. FIGS. 13 and 14 are a partial, enlarged sectional view of a detecting mechanism according to this embodiment for detection of a full state or an empty state of bins, and a perspective view of a bin according to still another embodiment, respectively. Light sources 70 and 71 comprising light-emitting elements to be used for detection of both an empty bin and a full bin are arranged at locations below the lower surfaces of the bins $33_1$ and $34_1$, respectively. Photosensitive elements 72 and 73 for detection of a full bin are arranged to face downward at the lower surfaces of the bins $33_1$ and $34_1$ to constitute a reflective sheet detecting mechanism.

Projections 76 and 77 extend from the upper part of the inner walls of the bins $32_1$ and $33_1$ and these projections have respective through holes 74 and 75 and respective inclined surfaces 78 and 79. Photosensitive elements 80 and 81 for detecting an empty bin are arranged to face upward at the bottoms of the bins $32_1$ and $33_1$ in such a manner that they are capable of receiving light emitted from the light sources 70 and 71 through the through holes 74 and 75, respectively. Printed circuit boards 82, 83 and 84 support the light sources 70 and 71 and the photosensitive elements 72, 73, 80 and 81. These printed circuit boards 82, 83 and 84 mount integrated circuits (IC) 85, 86 and 87, each comprising a light source drive circuit and a signal processing circuit of the photosensitive elements.

The mode of operation of the detecting mechanism of an empty bin of the construction as described above will now be described. Light rays 88 and 89 emitted by the light sources 70 and 71 arranged at the lower surfaces of the bins $33_1$ and $34_1$ pass through the through holes 74 and 75 and become incident on the photosensitive elements 80 and 81 for detecting an empty bin. Thus, it is detected that the bins $32_1$ and $33_1$ are empty. External light near the light rays 88 and 89 is eliminated by the projections 76 and 77 on the inner walls of the bins $32_1$ and $33_1$. External light rarely becomes incident on the photosensitive elements 80 and 81 for detecting an empty bin, so that erratic operation due to the external light may be prevented. When a sheet 90 indicated by the broken line is stacked on the bottom of the bin $33_1$, the light ray 89 is blocked thereby so that the light ray 89 does not reach the photosensitive element 81 for detecting an empty bin. Therefore, it is detected that the bin $33_1$ is not an empty bin.

The mode of operation of the mechanism for detecting a full bin will now be described. The sheets are sequentially guided in the direction shown by the arrow E by the bin switch pawl 32 and are stacked on the bottom of the bin $32_1$. When a sheet 91 is stacked on the inclined surface 78 of the projection 76 of the bin to block the through hole 74, the light ray 88 emitted from the light source 70 is reflected by the top surface of the sheet 91 and is detected by the photosensitive element 72 for detecting a full bin.

The light emitted from the light source 70 has a focal point near the inlet of the through hole 74 of the inclined surface 76. Therefore, unless the sheet is located on the inclined surface 76 to block the inlet of the through hole 74, the light ray 88 and the other light rays do not become incident on the photosensitive element 72 for detecting a full bin, so that detection of sheets may be performed without failure. The above description has been made with reference to the bins $32_1$ and $33_1$. However, the other bins are of the same construction and perform the same functions, so that the description thereof will be omitted.

Another embodiment of the bin will now be described with reference to FIG. 14. In this embodiment, the through holes of the bins $32_1$, $33_1$, . . . are slits. A bin 92 is of the same structure as the bin $32_1$, shown in FIG. 13 except that a slit 93 is formed in the projection 76 at the inner wall of the bin 92 in place of the through hole. Therefore, the light ray 88 emitted from the light source 70 may pass through this slit to become incident on the photosensitive element 80.

Figure 15:
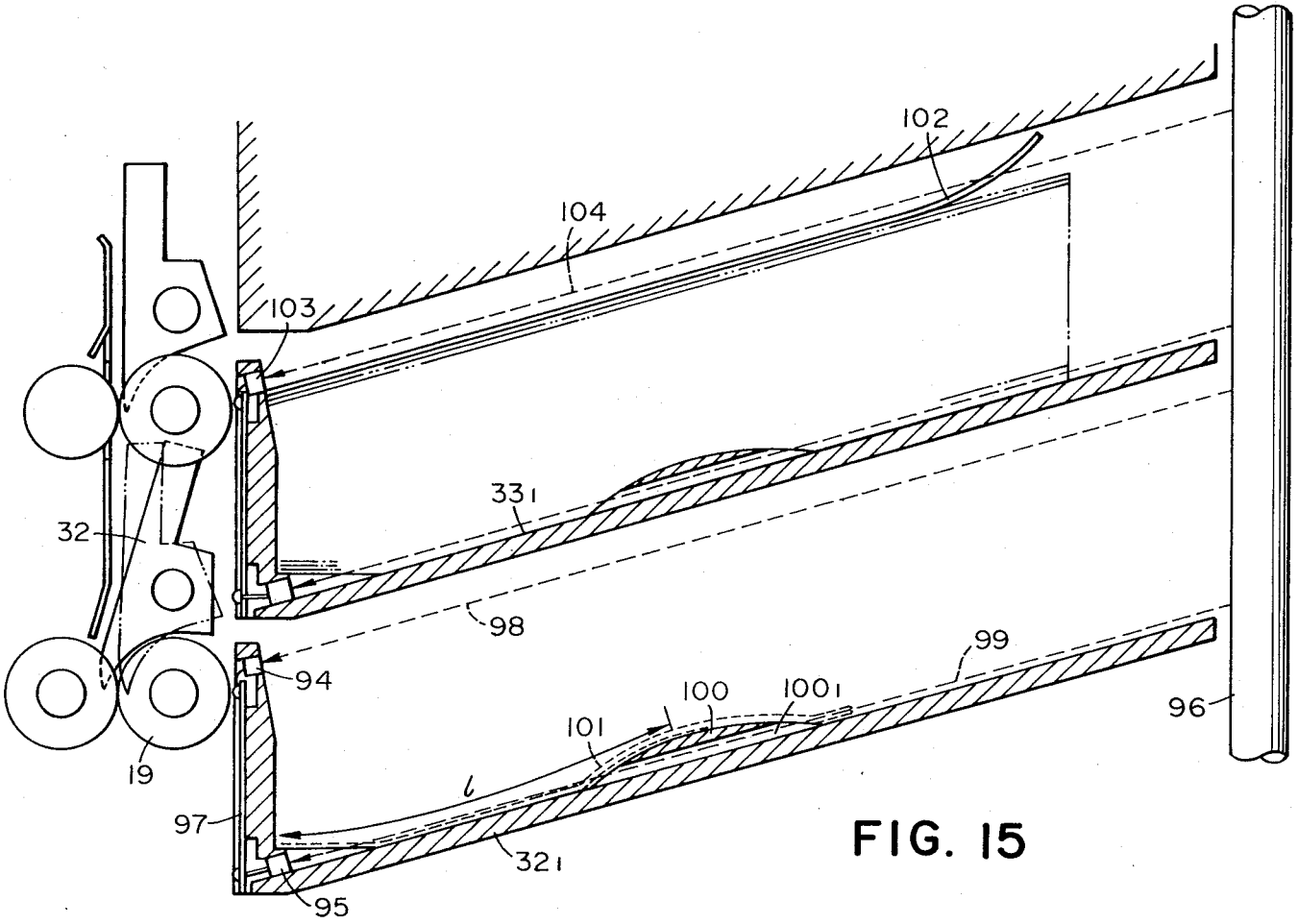
FIG. 15 is a partial, enlarged sectional view showing still another detecting mechanism.

Still another embodiment of the present invention will now be described with reference to the accompanying drawings. FIG. 15 is a partial, enlarged sectional view of the detecting mechanism for detecting an empty bin and a full bin of this embodiment. A photosensitive element 94 for detecting a full bin is mounted on a substrate 97 at a position near the sheet insertion inlet on the inner wall of the bin $32_1$, and a photosensitive element 95 for detecting an empty bin is mounted on the substrate 97 at a position near the bottom of the bin, so that these photosensitive elements may receive light emitted from a light source 96 such as a fluorescent lamp which is disposed at the other end of the bin and which illuminates the inside of the bin. The angles for light reception of these photosensitive elements 94 and 95 are narrow. The photosensitive element 94 receives a light ray 98 near the top part of the bin $32_1$ alone. Similarly, the photosensitive element 95 for detecting an empty bin receives a light ray 99 near the bottom of the bin $32_1$ alone. An undulation 100 having a through hole $100_1$ is formed at the center of the bottom of the bin $32_1$, so that the light ray 99 emitted by the light source 96 may pass through this through hole $100_1$ to become incident on the photosensitive element 95 for detecting an empty bin. The conveying rollers 19 are arranged near the inlet of the bin $32_1$. The bin switch pawl 32 is so switched by a solenoid (not shown) from the position indicated by the alternate long and two short dashes line to the position indicated by the solid line, to guide the sheet in the bin $32_1$. The other bins are of the same configuration.

The mode of detection of an empty bin and a full bin will now be described. The detection of an empty bin will first be described. Referring to FIG. 15, when there is no sheet in the bin $32_1$, the light ray emitted by the light source 96 becomes incident on the photosensitive element 95 for detecting an empty bin. When there is one sheet 101 as shown by the broken line in the bin $32_1$, this sheet blocks the through hole $101_1$ formed in the undulation 100 at the bottom of the bin $32_1$. Therefore, the photosensitive element 95 for detecting en empty bin does not receive light, and it is detected that the bin $32_1$ is not an empty bin. The undulation 100 at the bottom of the bin $32_1$ is located at a distance l from the inner wall of the bin, this distance l being shorter than the minimum length of the sheets to be stacked in the bin $32_1$. Therefore, independently of the size of the sheets to be used, when the sheet is stacked in the bin $32_1$, the through hole $100_1$ is blocked and it is detected that the bin is not empty.

Detection of a full bin will now be described. When a number of sheets are stacked in the bin $33_1$ in FIG. 15 and an uppermost sheet 102 blocks a light ray 104 which is emitted from the light source 96 and which is otherwise incident on a photosensitive element 103 for detecting a full bin, a full bin is detected. The sheet 102 blocks the light ray 104 and allows detection of a full bin, independently of the form of stacking or the size of the sheet 102.

Figure 16:
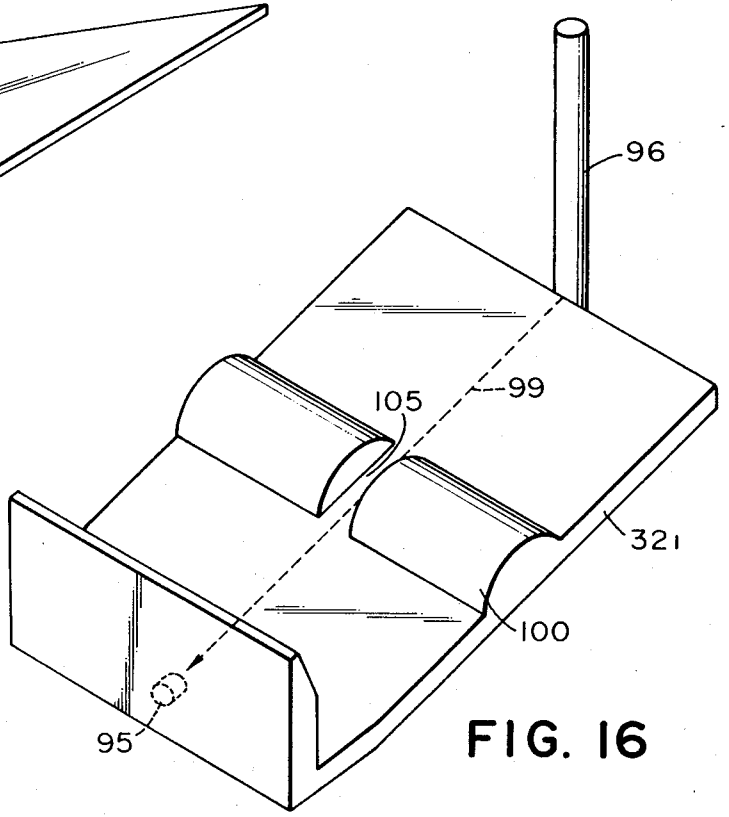
FIGS. 16 and 17 are, respectively, a perspective view and a sectional view of another embodiment of the present invention.
Figure 17:
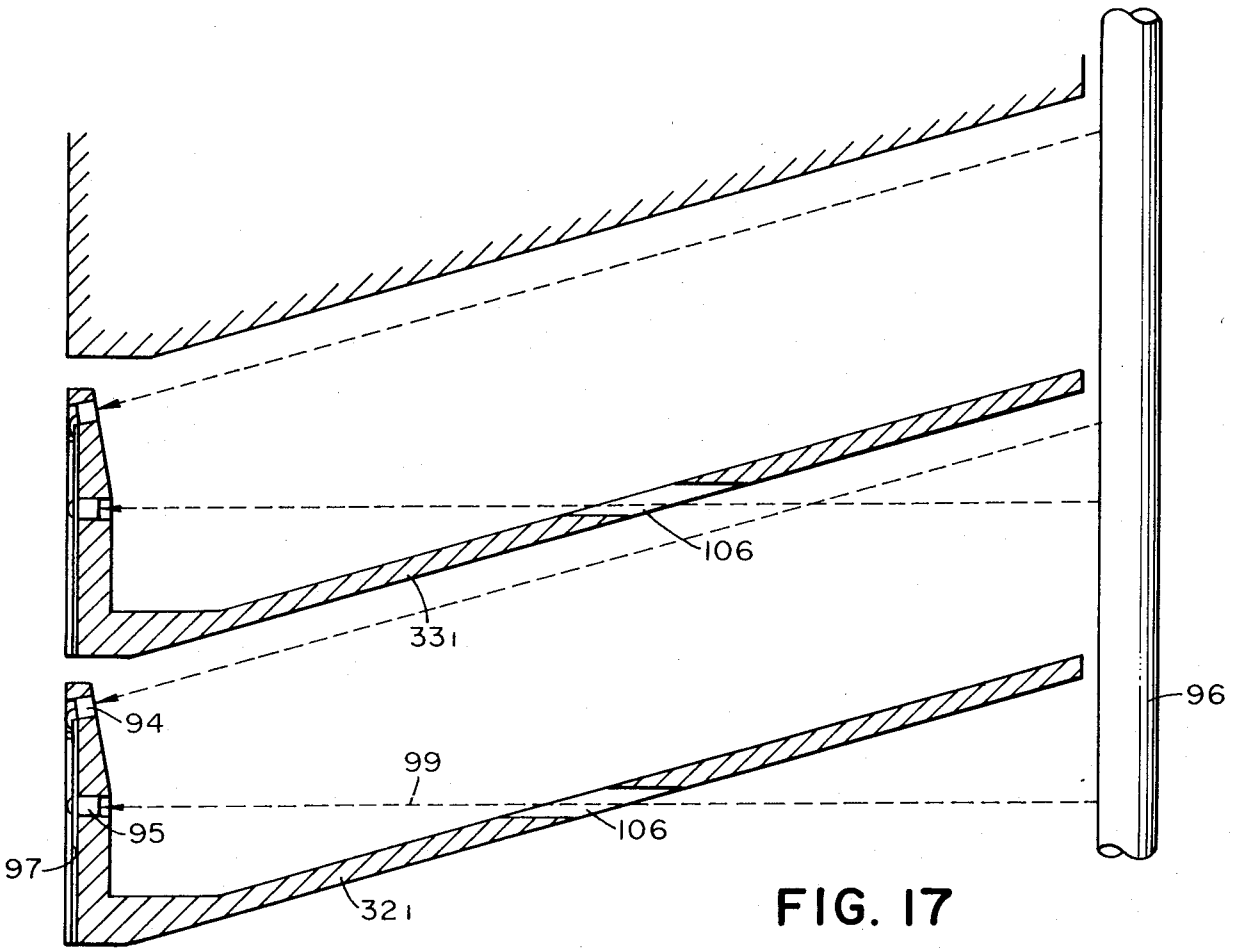

FIGS. 16 and 17 show still another embodime nt of the present invention. A bin shown in FIG. 16 has a groove 105 in place of the through hole in the undulation formed at the bottom of the bin. This groove 105 functions in the same manner as the through hole.

In the embodiment shown in FIG. 17, a hole 106 for allowing passage of the light ray 99 for detecting an empty bin is formed directly in the bottom of the bin.

The same reference numerals in FIGS. 16 and 17 denote the parts of the same functions.

What is claimed is:

1. A collator comprising:

a plurality of bin members capable of stacking sheets;

a first light-emitting element for detecting an empty bin, which is disposed at a bottom of a sheet stacking section of each of said bin members;

a second light-emitting element for detecting a full bin, which is disposed near a sheet insertion inlet of each of said bin members; and a common light-receiving element which is disposed at a bottom of an adjacent bin member and which receives light emitted from said first light-emitting element for detecting an empty bin and from said second light-emitting element for detecting a full bin, said light-receiving element being disposed obliquely to said second light-emitting element.

2. A collator according to claim 1, wherein said first light-emitting element and said second light-emitting element are selectively driven to detect an empty bin and a full bin, respectively.

3. A collator comprising:

a plurality of bin members arranged next to each other for stacking sheets;

one light-receiving element for detecting both an empty bin and a full bin, which is disposed near a sheet insertion inlet of each of said bin members; and one light-emitting element which is disposed at a sheet stacking section near a bottom of each of said bin members and which emits light to both of said light-receiving elements of two adjacent bin members for detecting a full bin by said light-receiving element of one of said two adjacent bin members and for detecting an empty bin by said light-receiving element of the other of said two adjacent bin members.

4. A collator comprising:

a plurality of bin members for stacking sheets;

a first light-receiving element for detecting an empty bin, which is disposed at a sheet stacking section near a bottom of each of said bin members;

a second light-receiving element for detecting a full bin, which is disposed near a sheet insertion inlet of each of said bin members; and a common light-emitting element which is disposed near the sheet insertion inlet and which emits light to said first light-receiving element for detecting an empty bin and to said second light-receiving element for detecting a full bin.

5. A collator according to claim 4, wherein said bin members are provided with means defining a hole therethrough and a light ray emitted from said light-emitting element passes through said hole and is incident on said first light-receiving element.

6. A collator according to claim 5, wherein a focal point of said light-emitting element is near an inlet of said hole.

7. A collator comprising:

a plurality of bin members for stacking sheets;

a first light-receiving element for detecting a full bin, which is disposed near a sheet insertion inlet of each of said bin members;

a second light-receiving element for detecting an empty bin, which is disposed at the sheet insertion inlet side near a bottom of each of said bin members; and a common light-emitting element for emitting light toward a leading edge of said bin member along a direction of travel of the sheet, to said first and second light-receiving elements.

8. A collator according to claim 7, wherein an undulation with an opening is formed at the bottom of each of said bin members so as to allow, through said opening, a light ray emitted by said common light-emitting element to be detected by said second light-receiving element for detecting an empty bin.

9. A collator according to claim 7, wherein the bottom of each of said bin members is formed with means defining an opening therethrough to allow the light ray emitted from said common light-emitting element to be incident on said second light-receiving element for detecting an empty bin.

10. A collator comprising:

(a) a plurality of bin members capable of stacking sheets;

(b) first detecting means having a light-emitting element and a light-receiving element oppositely disposed relative to the position of sheets to be stacked in said bin members for detecting the presence or absence of sheets in said bin members; and (c) second detecting means having a light-emitting element and a light-receiving element oppositely disposed relative to a sheet inserting port of said bin members for detecting an overflow state of the sheets representing a quantity of sheets greater than the quantity of sheets which can be stacked in said bin members, either one of said light-emitting element and said light-receiving element being adapted to be used commonly with respect to said first and second detecting means.

* * * * *